US005103575A

United States Patent [19]

Yokoo et al.

[11] Patent Number: 5,103,575

[45] Date of Patent: Apr. 14, 1992

[54] METHOD FOR IMPROVING QUALITIES OF WOOD

[75] Inventors: Kuniharu Yokoo, Nishinomiya; Yoshinori Kobayashi, Nara; Yasushi Kanagawa, Nagoya, all of Japan

[73] Assignee: Fuyo Lumber Sales Co., Ltd., Osaka, Japan

[21] Appl. No.: 649,840

[22] Filed: Feb. 5, 1991

[30] Foreign Application Priority Data

Feb. 5, 1990 [JP] Japan ..... 2-25468

[51] Int. Cl.[5] ..... F26B 3/34

[52] U.S. Cl. ..... 34/1 K; 34/1 L; 34/16.5; 34/17

[58] Field of Search ..... 34/1, 17, 13.4, 16.5, 34/60, 68, 1 K, 1 L

[56] References Cited

U.S. PATENT DOCUMENTS

| | | | |
|---|---|---|---|
| 2,560,763 | 7/1951 | Griffith, Jr. | 34/1 |
| 2,567,983 | 9/1951 | Wood | 34/1 |
| 3,031,767 | 5/1962 | Wood | 34/1 |
| 3,083,470 | 4/1963 | Pless | 34/1 |
| 3,456,356 | 7/1969 | Malmquist | 34/1 |
| 3,537,185 | 11/1970 | Ingram | 34/1 |
| 3,986,268 | 10/1976 | Koppelman | 34/1 |
| 4,258,240 | 3/1981 | Pless | 34/1 |
| 4,377,039 | 3/1983 | Häger | 34/1 |
| 4,466,198 | 8/1984 | Doll | 34/1 |
| 4,488,361 | 12/1984 | Lööf | 34/1 |

*Primary Examiner*—Henry A. Bennet
*Assistant Examiner*—Denise L. Gromada
*Attorney, Agent, or Firm*—Jones, Tullar & Cooper

[57] ABSTRACT

Wood is preliminary dried until its moisture content is reduced to 20 to 30%, and then treated by radio frequency heating in two stages, i.e., the first stage where the radio frequency heating is carried out at a temperature of 60° to 120° C., and the second stage where the radio frequency heating is carried out at a temperature of not more than 60° C.

3 Claims, No Drawings

METHOD FOR IMPROVING QUALITIES OF WOOD

The present invention relates to a method for improving qualities of wood and, more particularly, a method for preventing wood from exudation of resins.

Some species of wood, such as Douglas fir, have fine grain and excellent properties but they exude with resins as the time goes. Since the exudation of resins limits uses of wood, it is impossible to obtain a better yield of valuable products. In order to solve such a problem, some attempts have been made to prevent wood from resin exudation. One attempt is to carry out a heat-treatment of wood before or after artificial drying. Such a heat treatment may be accomplished easily by use of an artificial drying device heated by steam. It is however impossible with such a process to heat whole parts of the wood uniformly. Thus, the heat-treated wood exudes resins with the lapse of time.

Another attempt is steaming or boiling. Such a treatment makes it possible to remove resins from the wood surfaces, but the resins contained in the inner part of wood are scarcely removed. Thus, the steamed or boiled wood exudes with resins as the time goes. This exudation of resins takes place, especially, at cut ends of wood. In addition, such a treatment includes the following disadvantages. Firstly, the grains and appearance of wood is degraded as the resins are thoroughly removed from the wood's surfaces by steam or hot water. Secondary, it requires treatment of waste solutions containing resins when this process is put into practical use, resulting in increase of production cost of wood products.

Recently, research on prevention of resin exudation by radio frequency vacuum drying method is reported in "Lumber Industry", vol. 44-4, p15–18 (1988) by Mari Naito and Yasushi Kanagawa. In this drying method, woods are placed in vacuum with a pressure of 50 mmHg, heated to about 45° to 50° C. by radio frequency heating, and maintained at that low temperature for a prolonged time. Such a radio-frequency vacuum drying method is effective to reduce exudation of resins and causes almost no degradation of wood. However, this method takes about 5 to 15 days to dry the wood from its green state to about 15% of original moisture content, resulting in considerable increase in consumption of energy and in manufacturing cost of wood products. Thus, such a method can be used for drying expensive wood products.

To solve this problem, the inventors have tried to dry wood by radio frequency heating at higher temperatures of about 100° C. However, the rapid drying of wood causes a difference in moisture content between inner and outer parts of wood during drying, and thus inner stress due to the difference of moisture content causes checks or shakes.

SUMMARY OF THE INVENTION

It is therefore an object of the present invention to provide a method for improving qualities of wood, which makes it possible to prevent wood from exudation of resins, without causing defects such as checks or shakes and degradation of wood due to the process, as well as to minimize the time required for prevention of resin exudation.

The above and other objects of the present invention are achieved by a method comprising the steps of preliminarily drying wood until it contains between 20 to 30 percent of moisture, treating the preliminary dried wood by dielectric heating at a temperature where some components of resins are decomposed or polymerized, and then treating it by dielectric heating at a temperature lower than that temperature.

The wood may be any species and may take any desired shapes such as square timbers, boards, planks and the like.

In the present invention, the wood to be treated is preliminarily dried until its moisture content is reduced to about fiber saturation point which generally ranges from 20 to 30%, to minimize the time required for the next first dielectric heating step and to make the dielectric heating effective. If the moisture content is more than 30%, the time required for dielectric heating treatment becomes longer. If the moisture content is less than 20%, the time required for heating the wood to the temperature of the first radio frequency heating is considerably increased. The preliminary drying may carried out by any one of the conventionally used drying processes. It is however preferred to use an air drying method or a solar thermal drying method as the cost required for the preliminary drying can be minimized.

The preliminarily dried wood is then treated by the first dielectric heating so that components of resin contained in the wood are oxidized, decomposed to produce lower molecular compounds, or polymerized to produce higher molecular compounds. The dielectric heating is carried out by using a radio frequency heating device or a microwave heating device. During this dielectric heating step, the temperature of wood is maintained at a temperature where the chemical reactions such as oxidation, decomposition and condensation polymerigation, take place. The temperature varies with species of wood, but it generally ranges from 60° to 120° C. If the heating temperature is less than 60° C., the above chemical reactions do not take place sufficiently. If the temperature is more than 120° C., the qualities of wood are lowered. It is however preferred that the first dielectric heating is carried out at a temperature of 80° to 100° C. for several hours.

Finally, the thus treated board is further treated by the second dielectric heating to remove evaporable resin components contained in the wood. This second dielectric heating is carried out with a radio frequency heating device at a temperature lower than that of the first dielectric heating and especially at a temperature of less than 60° C. until the moisture content is reduced between 12 to 18%. The temperature of second dielectric heating has been limited to a temperature of less than 60° C. for the following reasons. If the temperature is more than 60° C., the wood is degraded by checks or shakes due to this step.

As mentioned above, according to the present invention, the preliminary dried wood is treated by radio frequency heating in two stages, i.e., the first stage where the radio frequency heating is carried out at a temperature of 60° to 120° C., and the second stage where the radio frequency heating is carried out at a temperature of not more than 60° C. Thus, the period of time required for dielectric heating treatment is reduced to about one-fifth a drying method where the green wood is dried by radio frequency heating until its moisture content is reduced to about 15%. Also, since the wood is slowly heated to a high temperature of 60° to 120° C., and since the removal of resins is slowly carried out by the second radio frequency heating at a temperature of not more than 60° C., there is no fear of checking or shaking due to difference in moisture content between inner and outer parts of wood.

PREFERRED EMBODIMENT OF THE INVENTION

Example 1

Using green heartwood of Douglas fir, there were prepared straight-grained boards 3.4 cm thick, 18 cm width and 30 cm length. Some green boards were preliminarily dried to 25% moisture content by a solar thermal drying method. The preliminarily dried boards were put into a radio-frequency heating device, heated to 90° C. in about 4 hours, and then maintained at that temperature for 2 hours to promote chemical reactions of resin components contained in the board. The boards were then treated at 60° C. for about 18 hours by the radio frequency heating until it is dried to 11% moisture content.

The thus treated boards were cut off both lateral sides by about 1 cm from edge with a sawing machine, cut off both ends by about 5 mm from edge, and then shaved off both faces by about 2 mm with a planer to prepare samples 3 cm thick, 16 cm width and 20 cm length.

Comparative Example 1

Using the green board prepared in Example 1, comparative specimen was prepared in the following manner: The green board was dried to 25% moisture content by the solar thermal drying method. The dried board was sawed and then planed in the same manner as that in Example 1 to prepare a specimen with the same size that the specimen of Example 1 has.

Comparative Example 2

The green board prepared in Example 1 was dried to 25% moisture content by a solar thermal drying method, and then dried to 6% moisture content by a hot air drying method.

Comparative Example 3

The green board prepared in Example 1 was dried to 25% moisture content by the solar thermal drying method, boiled in hot water at 100° C. for 8 hours, and then dried to 6% moisture content by a hot air drying method.

Comparative Example 4

The green board prepared in Example 1 was dried to 25% moisture content by the solar thermal drying method, and then dried to 7% moisture content by heating it at 60° C. for about 3 days with the radio frequency drying device.

Experiment 1

For each sample, visual observation was made to evaluate the extent of resin exudation just after the planing step. Results are summarized in Table 1a.

The samples were then stored for 72 hours in a thermostat controlled at 60° C., and then visual observation was made to evaluates the extent of resin exudation. Results are summarized in Table 2b.

TABLE 1a

| | Sample 1 | Compara. sample 1 | Compara. sample 2 | Compara. sample 3 | Compara. sample 4 |
|---|---|---|---|---|---|
| Cut end | Very very slightly dotted with resins | Slightly dotted with resins | Slightly dotted with resins | Very slightly dotted with resins | Very slightly dotted with resins |
| Face | Very slightly dotted with resins | Very slightly dotted with resins | Very slightly dotted with resins | Slightly dotted with resins | Very slightly dotted with resins |
| Resin canal | No resins | Resins exist | Resins exist | No resins | No resins |
| Resin pocket | No resin | Filled with resins | No resin | — | — |

TABLE 1b

| | Sample 1 | Compara. sample 1 | Compara. sample 2 | Compara. sample 3 | Compara. sample 4 |
|---|---|---|---|---|---|
| Cut end | Partially exuded with resins | Whole surface exuded with resins | Whole surface exuded with resins | Surface exc. periphery exuded with resins | Partially exuded with resins |
| Face | Very slightly exuded with resins | Whole surface exuded with resins | Exuded fairly with resins | Very slightly exuded with resins | Very slightly exuded with resins |
| Resin canal | No resin | Both sides were spread with resins | Both sides were spread with resins | No resin | No resin |
| Pitch pocket | No resin | Overflowed | Exuded with resins | — | — |
| Luster | Unchanged | Unchanged | Unchanged | Lost | Unchanged |
| Remarks | Very slightly sticky | Sticky | Sticky | No stickiness | Very slightly sticky |

From the results in Table 1a, it can be seen that the sample of Example 1 and that of comparative examples 1 to 4 scarcely show deference in resin exudation just after planing. However, they show great difference in the resin exudation after stored for 72 hours in the thermostat.

As can be seen from the data in Table 1b, the sample of Example 1 and that of comparative example 4 scarcely exude resins even after stored at 70° C. for 72 hours. In contrast therewith, the sample of comparative sample 2 exudes a great amount of resins as well as that of the comparative sample 1. This means that hot air drying is not effective for prevention of resin exudation.

As will be seen from the data for comparative sample 3, the boiling treatment makes it possible to prevent the exudation of resins from the wood surfaces but it is not effective to prevent the exudation of resins from the interior of wood. In addition, the appearance of wood is degraded by the boiling treatment as the wood loose its luster.

Accordingly, the combination of the preliminary drying and radio frequency heating is effective for prevention of resin exudation.

Experiment 2

The samples prepared in Example 1 and comparative examples 1 to 4 were observed visually to evaluate the extent of resin exudation. Results are shown in Table 2a.

After storing these samples for about 1 month in a room controlled at 10° to 25° C., they were observed visually to evaluate the extent of resin exudation. Results are shown in Table 2b.

As will be seen from the results in Tables 2a and 2b, sample 1 and comparative sample 4 scarcely exude with resins even after storing. Thus, it can be said that a combination of a preliminary drying and radio frequency heating is effective for preventing wood from exudation of resins.

In contrast therewith, the comparative sample 1 exudes with resins through its cut ends and faces when it is stored in the room for about 1 month. The resins would grow in a teardrop with the lapse of time. Thus, the solar thermal drying method is ineffective for the prevention of resin exudation.

The comparative sample 2 exudes with resins of which an amount is smaller than that of the comparative sample 1, but greater than that of sample 1 or comparative sample 3 or 4. Thus, the hot air drying method is inferior in the prevention of resin exudation to the method of the present invention. The comparative sample 3 slightly exudes with resins through the central parts of cut end, but it has no luster. Thus, the boiling treatment is ineffective for the prevention of resin exudation.

TABLE 2a

| | Sample 1 | Compara. sample 1 | Compara. sample 2 | Compara. sample 3 | Compara. sample 4 |
|---|---|---|---|---|---|
| Cut end | Very slightly dotted with resins | Slightly dotted with resins | Slightly dotted with resins | No resins | Very slightly dotted with resins |
| Face | No resin | Slightly dotted with resins | Slightly dotted with resins | No resin | Very slightly dotted with resins |
| Resin canal | No resins | Resins exist | Resins exist | No resin | No resin |
| Remarks | Not sticky | Sticky | Sticky | Not sticky No luster | Not sticky |

TABLE 2b

| | Sample 1 | Compara. sample 1 | Compara. sample 2 | Compara. sample 3 | Compara. sample 4 |
|---|---|---|---|---|---|
| Cut end | Exuded with a very very small amount of resins | Whole surface exuded with resins | Exuded with a small amount of resins | Surface exc. periphery exuded with resins | Exuded with a very small amount of resins |
| Face | No resin | Whole surface exuded with resins | Slightly exuded with resins | Very slightly exuded with resins | Very slightly exuded with resins |
| Resin canal | No resin | Resin spread broadly | Resin spread slightly | Resin spread very slightly | Resin spread very slightly |
| Remarks | Not sticky | Sticky | Not sticky | Not sticky No luster | Not sticky |

Experiment 3

The samples prepared in Example 1 and comparative examples 1 to 4 were observed visually to evaluate the extent of resin exudation. Results are shown in Table 3a.

These samples were stored at 5° to 25° C. for about 1 month in the open without exposing to the sun and the rain. Then, the samples were observed as to resin exudation. Results are shown in Table 3b.

As will be seen from the results in Tables 3a and 3b, sample 1 and comparative sample 4 scarcely exude with resins even after storing and have good luster even after the radio frequency heating treatment.

In contrast therewith, the comparative sample 1 exudes with resins at its cut ends and faces when it is stored in the open for about 1 month. The resins would grow in a teardrop with the lapse of time. Thus, the solar thermal drying method is ineffective for the prevention of resin exudation.

The comparative sample 2 exudes with resins of which an amount is smaller than that of the comparative sample 1, but greater than that of sample 1 or comparative sample 3 or 4. Thus, the hot air drying method is inferior in the prevention of resins exudation to the method of the present invention. The comparative sample 3 slightly exudes with resins through the central parts of cut end, but it has no luster.

TABLE 3a

| | Sample 1 | Compara. sample 1 | Compara. sample 2 | Compara. sample 3 | Compara. sample 4 |
|---|---|---|---|---|---|
| Cut end | Very slightly dotted | Slightly dotted with | Very slightly dotted | Very slightly dotted | Very very slightly |

TABLE 3a-continued

| | Sample 1 | Compara. sample 1 | Compara. sample 2 | Compara. sample 3 | Compara. sample 4 |
|---|---|---|---|---|---|
| | with resins | resins | with resins | with resins at cent. part | dotted with resins |
| Face | Very slightly dotted with resins | Slightly dotted with resins | Slightly dotted with resins | No resin | Very slightly dotted with resins |
| Resin canal | Very very slightly dotted with resins | Resins exist | Resins exist slightly | No resin | Very slightly dotted with resins |
| Remarks | — | — | — | No luster | — |

TABLE 3b

| | Sample 1 | Compara. sample 1 | Compara. sample 2 | Compara. sample 3 | Compara. sample 4 |
|---|---|---|---|---|---|
| Cut end | Exuded very very slightly with resins | Whole surface exuded with resins | Exuded fairly with resins | Cent. part exuded slightly with resins | Exuded very slightly with resins |
| Face | Exuded very slightly with resins | Exuded fairly with resins | Slightly exuded with resins | No resins | Very slightly exuded with resins |
| Resin canal | Resin spread slightly | Resin spread broadly | Resin spread broadly | Resin spread at cent. part | Resin spread very slightly |
| Remarks | — | — | — | No luster | — |

Thus, it can be said that a combination of a preliminary drying and radio frequency heating is effective for preventing wood from exudation of resins.

Experiment 4

Each sample prepared in Example 1 or comparative example was shaved off by 2 to 5 mm from the face to prepare wood shavings for extraction of wood components. The resultant wood shavings (2.5 g) were placed in a Soxhlet extractor together with 100 ml of a solvent consisting of 2:1 mixture of benzen and ethyl alcohol and extraction of wood components was carried out for 5 hours. After removing the solvent by evaporation, weight of an extract was measured. Results are shown in Table 4 together with (A) a ratio of the extract to the wood shavings and (B) the proportion of the decrease amount of extract with respect to the amount of the extract contained in comparative sample 1.

TABLE 4

| | Sample 1 | Compara. sample 1 | Compara. sample 2 | Compara. sample 3 | Compara. sample 4 |
|---|---|---|---|---|---|
| Shavings | 2.5 g | 2.5 g | 2.5 g | 2.5 g | 2.5 g |
| Ext. | 75 mg | 135 mg | 131 mg | 107 mg | 103 mg |
| A | 3.0% | 5.4% | 5.2% | 4.3% | 4.1% |
| B | 44% | 0 | 3% | 21% | 24% |

As can be seen from the results shown in Table 4, the amount of the extract contained in a layer of wood at a depth of 2 to 5 mm from the face becomes smaller in the order, comparative sample 1, comparative sample 2, comparative sample 3, comparative sample 4, sample 1. In other words, the content of resins is minimum for sample 1, but maximum for comparative sample 1.

It is considered that the content of resins in sample 1 is minimized by the method of the present invention for the following reasons. Since the resins contained in wood are mainly composed of carbon compounds having carbon atoms of not more than 24, some parts of resins are oxidized or decomposed during the first radio frequency heating at 90° C. for 2 hours to produce volatile carbon compounds with a lower molecular weight, and the produced volatile compounds are then removed in the form of gas or vapor of an azeotropic mixture for example from the wood together with moisture contained therein during subsequent radio frequency heating at a temperature of 60° C.

In contrast therewith, taking account of the data in Tables 1 to 4 for comparative sample 2, it is considered that, during the artificial hot air drying, the resins are partially removed from the outer layer of wood, but scarcely removed from an inner layer of wood with a depth of not less than 2 mm from the face. Thus, the air-dried wood finished by planing exudes with resins as the time goes.

For comparative sample 3, the resins are washed out from the surface of wood by boiling water, so that no resin is found on the surface of the sample. However, the inner layer of the sample contains resins in an amount of 80% of the initial content, so that it exudes with the resins as the time goes.

From the data for comparative sample 4, it is concluded that, by radio frequency heating of the preliminary dried wood at a temperature of 60° C. or below, some parts of volatile compounds are removed together with moisture in the form of gas or vapor of an azeotropic mixture for example. Since the reactions due to radio frequency heating becomes slow at low temperature, the most volatile components of resins are those originally contained in the wood. Thus, the amount of the resins removed is greater than that of comparative samples 2 and 3, but smaller than that of sample 1.

Experiment 5

For each sample, the extract (2 μl) prepared in Experiment 4 was analyzed with a gas chromatography to determine a distribution of molecular weight of compounds contained therein. Results are shown in Table 5. In Table 5, n is the degree of polymerization for $C_nH_{2n+2}$ corresponding to the holding time of gas chromatography.

TABLE 5

| n | Sample 1 | Compara. sample 1 | Compara. sample 2 | Compara. sample 3 | Compara. sample 4 |
|---|---|---|---|---|---|
| less than 15 | 8.4 ng (25%) | 7.9 ng (16%) | 8.4 ng (20%) | 7.1 ng (18%) | 7.0 ng (20%) |
| 16 | 7.6 ng (23%) | 22.5 ng (46%) | 16.0 ng (38%) | 15.2 ng (39%) | 11.5 ng (33%) |
| 17–18 | 4.5 ng (13%) | 6.1 ng (12%) | 6.1 ng (14%) | 5.6 ng (14%) | 4.7 ng (13%) |
| 19–20 | 11.7 ng (35%) | 9.5 ng (19%) | 9.6 ng (23%) | 8.9 ng (23%) | 10.2 ng (29%) |
| 20–24 | 1.5 ng (4%) | 3.2 ng (7%) | 2.1 ng (5%) | 2.2 ng (6%) | 1.8 ng (6%) |
| Total | 33.7 ng | 49.2 ng | 42.2 ng | 39.0 ng | 35.2 ng |

As can be seen from the results shown in Table 5, the content of a compound with n=16 for sample 1 is reduced to approximately one-third the value of comparative sample 1, but the content of compounds with n=19–20 is increased by 20% as compared with comparative sample 1.

In contrast therewith, comparative sample 2 contains carbon compounds of which a distribution of molecular weight is similar to that of comparative sample 1 although the content of a compound with n=16 is slightly decreased as compared with comparative sample 1. Also, for comparative sample 3, the content of the compound with n=16 is decreased as compared with comparative sample 2, but the contents of other compounds are the same as those of comparative sample 2. For comparative sample 4, the content of the compound with n=16 is further decreased as compared with comparative sample 3, but the content of the compounds with n=19–20 is increased as compared with comparative sample 3. However, changes in the content of the compound with n=16 and in the content of the compounds with n=19–20 are smaller than those for sample 1.

Accordingly, it can be said that the radio frequency heating increases the mean molecular weight of resins components, which in turn causes increase in the viscosity of resins contained in the wood. In general, the greater the viscosity of resins, the smaller is its mobility. For this reason, the resins contained in the inner layer of wood are prevented from exudation to the wood surface.

Experiment 6

Each sample prepared in example 1 and comparative examples 1 to 4 were sliced to prepare a specimen for observation by a microscope. The specimen was stained with azo dye (Sudan III) and then observed by a microscope.

For sample 1 and comparative sample 5, the microscopic observation showed that the resins are fairly removed from canals, that the resins remaining in the resin canals are adhered to inner walls of the canals, and that the resins to be found in the radial intercellular canals are migrated to positions around the radial intercellular canals. Thus, the resins remaining in the wood are prevented from exudation to the wood surface.

For comparative samples 1, 2 and 3, the microscopic observation showed that foamy resins remain in the resin canals and that the radial intercellular canals are filled with the resins.

What is claimed is:

1. A method for preventing resin exudation from wood, comprising the steps of preliminarily drying said wood until it contains between 20 to 30 percent moisture, treating the preliminarily dried wood with a first dielectric heating step at a temperature ranging from 60° C. to 120° C. whereby some resinous components of said wood are reacted, and further treating said wood with a second dielectric heating step at a temperature of less than 60° C. to remove evaporable resin components contained in said wood.

2. A method according to claim 1 wherein preliminary drying step is carried out by an air drying method.

3. A method according to claim 1 wherein the preliminary drying step is carried out by a solar thermal drying method.

* * * * *